US008156715B2

(12) United States Patent
Nowak et al.

(10) Patent No.: US 8,156,715 B2
(45) Date of Patent: Apr. 17, 2012

(54) METHOD OF STORING AND DISPENSING PAPER IN A REAM WRAP

(75) Inventors: Michael R. Nowak, Hilbert, WI (US); David W. Schneider, Elkhart Lake, WI (US)

(73) Assignee: Coating Excellence International LLC, Wrightstown, WI (US)

( * ) Notice: Subject to any disclaimer, the term of this patent is extended or adjusted under 35 U.S.C. 154(b) by 986 days.

(21) Appl. No.: 11/852,581

(22) Filed: Sep. 10, 2007

(65) Prior Publication Data

US 2008/0061120 A1 Mar. 13, 2008

Related U.S. Application Data

(62) Division of application No. 10/797,312, filed on Mar. 10, 2004, now abandoned.

(51) Int. Cl.
*B65D 65/26* (2006.01)

(52) U.S. Cl. ..... 53/133.3; 53/133.8; 229/87.05

(58) Field of Classification Search ..... 53/133.3–133.8; 229/87.05
See application file for complete search history.

(56) References Cited

U.S. PATENT DOCUMENTS

| | | | | |
|---|---|---|---|---|
| 1,994,468 | A | 3/1935 | Freeman | |
| 2,475,052 | A * | 7/1949 | Rosen | 229/87.09 |
| 2,538,564 | A * | 1/1951 | Jensen et al. | 53/412 |
| 2,725,172 | A * | 11/1955 | McCullough et al. | 229/87.05 |
| 3,278,019 | A * | 10/1966 | Martin et al. | 206/555 |
| 3,379,364 | A | 4/1968 | Pilger | |
| 3,566,752 | A * | 3/1971 | Dreher | 493/197 |
| 4,022,373 | A * | 5/1977 | Kohnlein et al. | 229/87.05 |
| 4,093,069 | A | 6/1978 | Smolderen | |
| 4,773,541 | A | 9/1988 | Riddell | |
| 4,848,649 | A * | 7/1989 | Fuller et al. | 229/123.2 |
| 4,947,994 | A | 8/1990 | Newsome | |
| 5,366,295 | A * | 11/1994 | Montesissa et al. | 383/201 |
| 5,489,060 | A * | 2/1996 | Godard | 229/87.05 |
| 5,783,266 | A * | 7/1998 | Gehrke | 428/34.3 |
| 6,006,907 | A * | 12/1999 | Sato et al. | 206/387.1 |
| 6,061,997 | A * | 5/2000 | Ozaki et al. | 53/412 |
| 6,138,437 | A * | 10/2000 | Focke et al. | 53/133.7 |
| 6,375,069 | B1 * | 4/2002 | Smith | 229/211 |
| 2005/0006265 | A1 * | 1/2005 | Anderson et al. | 206/449 |
| 2005/0189406 | A1 * | 9/2005 | Welchel et al. | 229/235 |
| 2006/0027637 | A1 | 2/2006 | Conrad | |
| 2007/0022716 | A1 * | 2/2007 | Bellmann et al. | 53/412 |

FOREIGN PATENT DOCUMENTS

| | | | |
|---|---|---|---|
| EP | 0595722 | A1 | 5/1994 |
| GB | 2156303 | A | 10/1985 |
| GB | 2206555 | A | 1/1989 |

* cited by examiner

*Primary Examiner* — Hemant M Desai
(74) *Attorney, Agent, or Firm* — Duane Morris LLP

(57) ABSTRACT

A packaging for reams of cut paper involving tear tapes made of plastic or paper maternal inserted into the ream wrap. The tear tapes may be pulled to tear off and open one end of the wrapped ream, leaving the remaining packaging intact to serve as a storage and dispenser for partial reams of paper.

5 Claims, 6 Drawing Sheets

FIG. 6
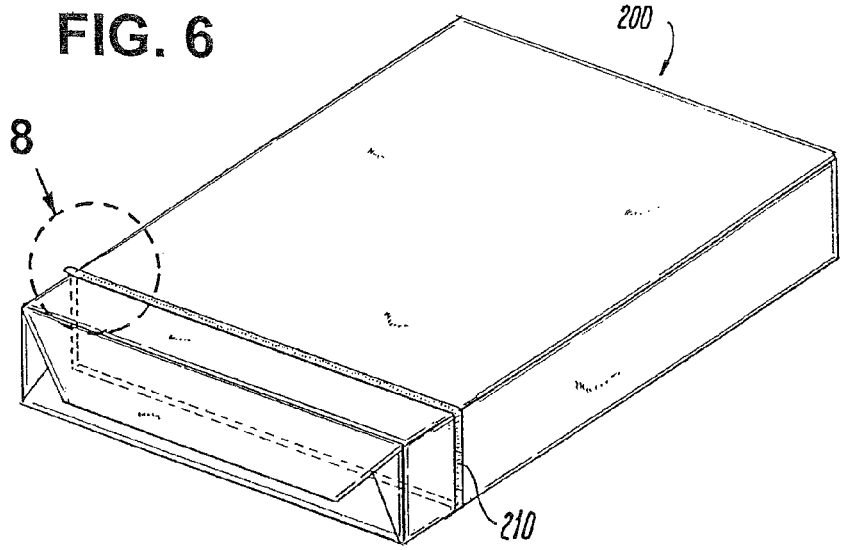
FIG. 7
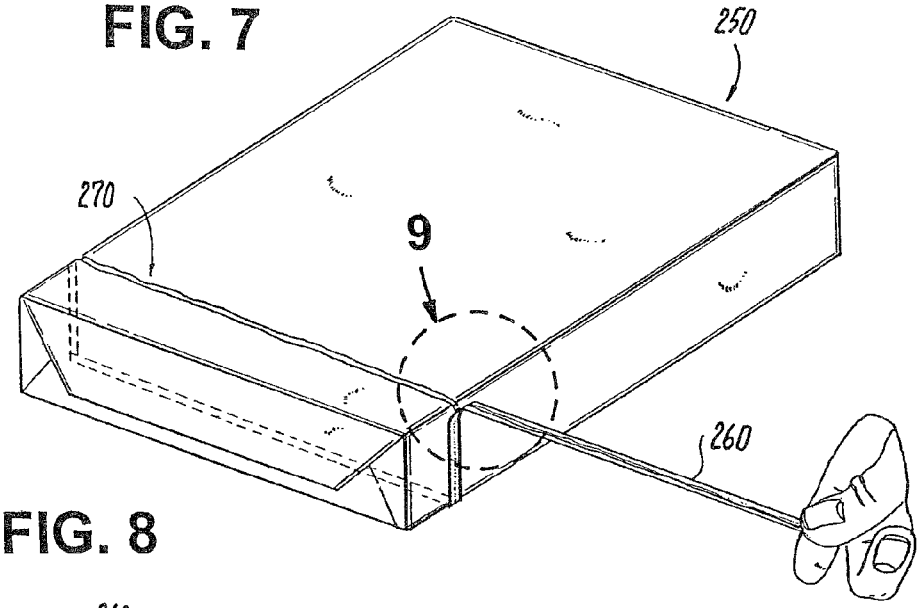
FIG. 8
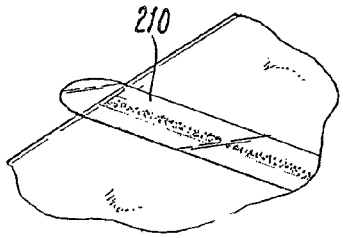
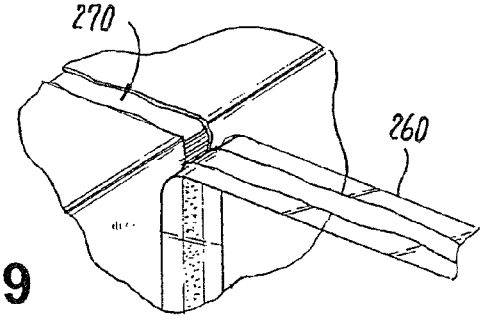
FIG. 9

FIG. 10
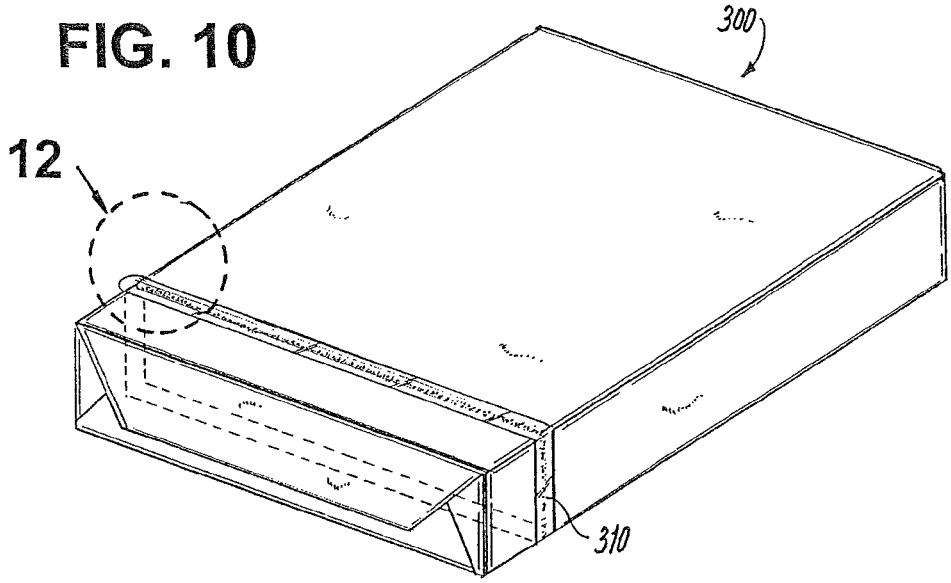
FIG. 11
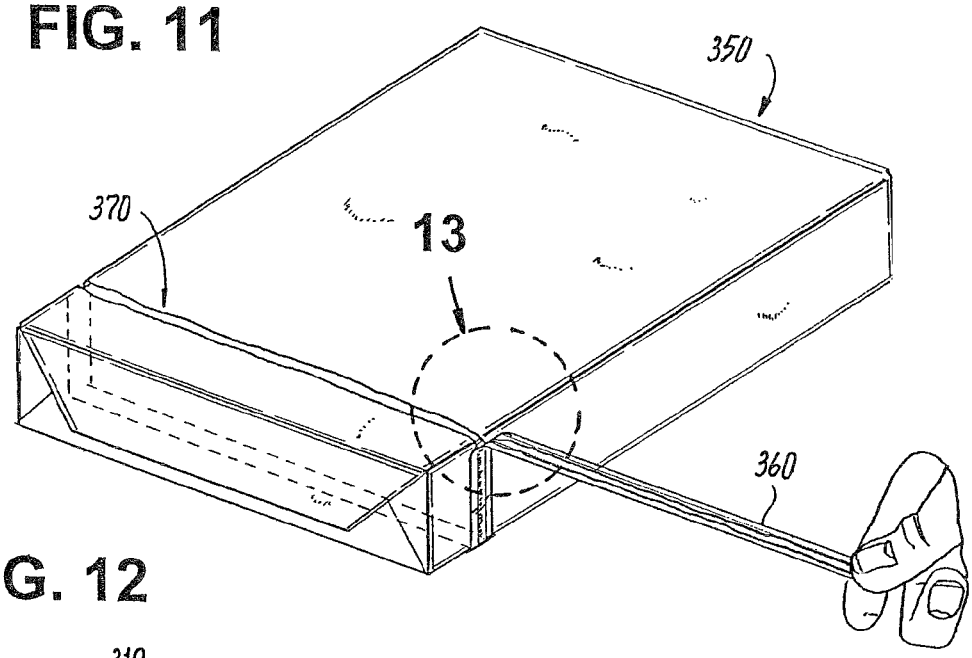
FIG. 12
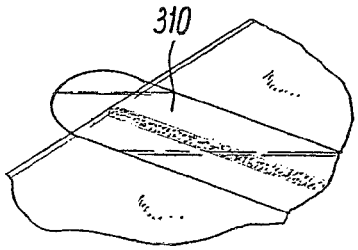
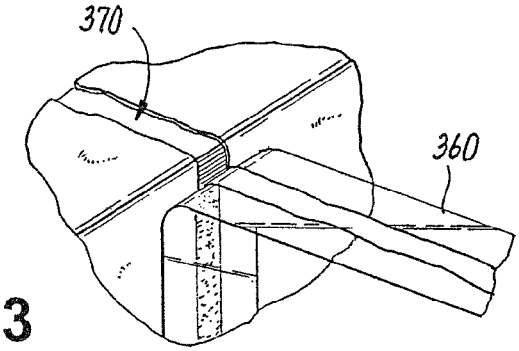
FIG. 13

METHOD OF STORING AND DISPENSING PAPER IN A REAM WRAP

CROSS REFERENCE TO RELATED APPLICATIONS

The present application is a divisional of U.S. Ser. No. 10/797,312, filed Mar. 10, 2004, now abandoned.

FIELD OF THE INVENTION

The present invention relates to a novel packaging for reams of cut paper involving tear tapes made of plastic or paper material inserted into the ream wrap. The tear tapes may be pulled to tear off and open one end of the wrapped ream, leaving the remaining packaging intact to serve as a storage and dispenser for partial reams of paper.

BACKGROUND OF THE INVENTION

Traditional packaging for wrapped reams (i.e., 500 sheets) of cut paper (8½×11, etc.) for copy machines, computers, printers, and other applications involves folding and overlapping the tops and bottom ends of the packaging and sealing the folded ends using heat or adhesive materials. Reams are most commonly packaged for shipping, storage, and retail sale in ream wrap made of various materials, including the traditional paper (poly coated or two papers laminated with poly), plastic film, or a paper/film combination. In addition to encasing the reams of paper, the wrap materials protect the paper from physical damage and moisture pickup during shipping and storing. The wrap materials also protect paper products from physical damage during repeated handling and stocking on retail shelves.

As small offices and home offices have proliferated, the distribution and sale of reams of paper have changed from boxes for large users to wrapped individual reams for retail stores and the small office and home office users. A major disadvantage of traditional ream wrap packaging for the individual user is that the current method of opening the packaging destroys the integrity of the entire wrapped ream. For instance, when the folded bottom or top end of the wrapped ream is torn open, the entire folded package opens, destroying the integrity of the wrapped structure and exposing and scattering the loose sheets of paper remaining in the ream. For the individual user who uses only a portion of the ream at a time and needs to store the remaining sheets, the unbound papers pose an inconvenience and impediment to storage. Since the structural support of the original packaging is compromised, the result for individual users is often physical damage to the unbound sheets of paper being stored for future use. The current marketplace demands a ream wrapper that may be opened so that a user may remove part of a ream and store the remaining sheets in a structure that prevents physical damage and scattering of loose papers.

SUMMARY OF THE INVENTION

The present invention relates to a ream wrapper that is opened so that a user may remove part of a ream and store the remaining sheets in a structure that prevents physical damage and scattering of loose parts.

The present invention relates to a ream wrapper that is opened so that a user removes part of a ream of paper and stores remaining sheets in the ream wrapper. The opened ream wrapper prevents physical damage to the remaining sheets and prevents scattering of loose pieces of paper. It is an object of the present invention for the ream wrap to be opened by at least one tear tape.

The present invention relates to a ream wrapper comprising; a ream wrap. The ream wrap has one or more tear tapes inserted in the ream wrap across they web so that it surrounds the entire width of a wrapped ream. It is an object of the present invention for the tear tape to comprise a strip of paper or film that is drawn through or coated with wax. It is an object of the present invention for the tear tape to be 1/32" to 1½". It is an object of the present invention for the tear tape to be torn lengthwise, not across the width of the tear tape.

It is an object of the present invention for the tar tape to comprise a non-coated strip of paper or film that is heat-sealed onto the ream wrap. It is an object of the present invention for the tear tape to comprise a strip of high strength poly film such as polyethylene or polypropylene, with adhesive on one side of the strip. It is an object of the present invention for the tear tape to comprise identical material from which the ream wrap itself is made. It is an object of the present invention for the ream wrap and the tear tape to both be made of shrink wrap.

It is an object of the present invention for the tear tape to be printed with a company name, logo, design, or other statement. It is an object of the present invention for the tear tape to be attached by an adhesive. It is an object of the present invention for the rearm wrap to have a tear tape on top of the ream wrap which opens the top of the ream wrap but keeps the integrity of the ream wrap. It is an object of the present invention for the ream wrap to have a tear tape that does not completely remove a section of the ream wrap.

The present invention relates to a method for opening a ream of paper comprising: pulling a tear tape across a ream wrap, opening a portion of the ream wrap and removing one sealed end of the ream wrap while the remaining ream wrap is left intact for storage and dispensing of partial reams.

An object of the present invention is to enable large users of reamed papers, such as insurance companies and other large users, to have a quicker way of opening multiple reams. Large users typically open and use several hundred reams of paper each business day. Currently, these users crack open and tear each individual ream by hand. The use of a tear tape to tear open the end of the ream enables this procedure to be done more quickly and efficiently. The user could tear the tape to remove one end of the packaging and quickly pull off the other end of the wrapper.

It is a further object of the present invention for the tear tape to be inserted in the ream wrap across the web so that it surrounds the entire width of the wrapped ream. When pulled, the tear tape opens one portion of the top or bottom end of the package, much like the tear tape on the firm package encasing a pack of cigarettes or gum. When pulled, the tear tape opens and enables the removal of one of the sealed ends of the ream wrap while leaving the remaining structure intact for storage and dispensing partial reams.

BRIEF DESCRIPTION OF THE DRAWINGS

FIG. 6 is a front view showing the ream wrap having a tear tape in the closed position;

FIG. 7 is; a ream wrap having the tear tape in the open position;

FIG. 8 is a cross sectional view of the tear tape shown in FIG. 6;

FIG. 9 is a cross sectional view of the tear tape shown in FIG. 7;

FIG. 10 is a front view showing the ream wrap having a tear tape in the closed position;

FIG. 11 is a ream wrap having the tear tape in the open position;

FIG. 12 is a cross sectional view of the tear tape shown in FIG. 10;

FIG. 13 is a cross sectional view of the tear tape shown in FIG. 11;

DETAILED DESCRIPTION OF THE INVENTION

The present invention relates to a method of wrapping reams of paper involving the insertion of one or more tear tapes into the ream wrap. The tear tape, when pulled, enables the opening and removal of a sealed end of the ream wrap leaving a portion of the wrapper intact to protect, store, and dispense partial reams of paper. The tear tape is inserted in the ream wrap across the web and can be applied to any type of ream wrap packaging, including papery/poly, film, paper/film combination, or shrink wrap.

In one embodiment, the tear tape comprises a strip of paper or film that is drawn through or coated with wax. The wax is used to adhere the tear tape to the ream wrap. The tear tape is 1/32" to 1½" in width and is torn lengthwise, not across the width of the strip.

In another embodiment, the tear tape comprises a non-coated strip of paper or film that is heat-sealed onto the ream wrap. The tear tape is 1/32" to 1½" in width and is torn lengthwise, not across the width of the strip.

In another embodiment, the tear tape comprises a strip of high strength poly film, such as polyethylene or polypropylene, with adhesive on one side of the strip. The adhesive is used to adhere the strip to the ream wrap. The tear tape is 1/32" to 1½" in width and is torn lengthwise, not across the width of the strip.

In another embodiment, the tear tape comprises the identical material from which the ream wrap itself is made. For instance, in the case of shrink wrap ream wrap, the tear tape would be made of a similar film material so that it would shrink in proportion to the ream wrap itself. The tear tape is 1/32" to 1½" in width and is torn lengthwise, not across the width of the tape.

In any of these embodiments, the tear tape may or may not be printed with a company name, logo, design, or other statement.

Figure 1:
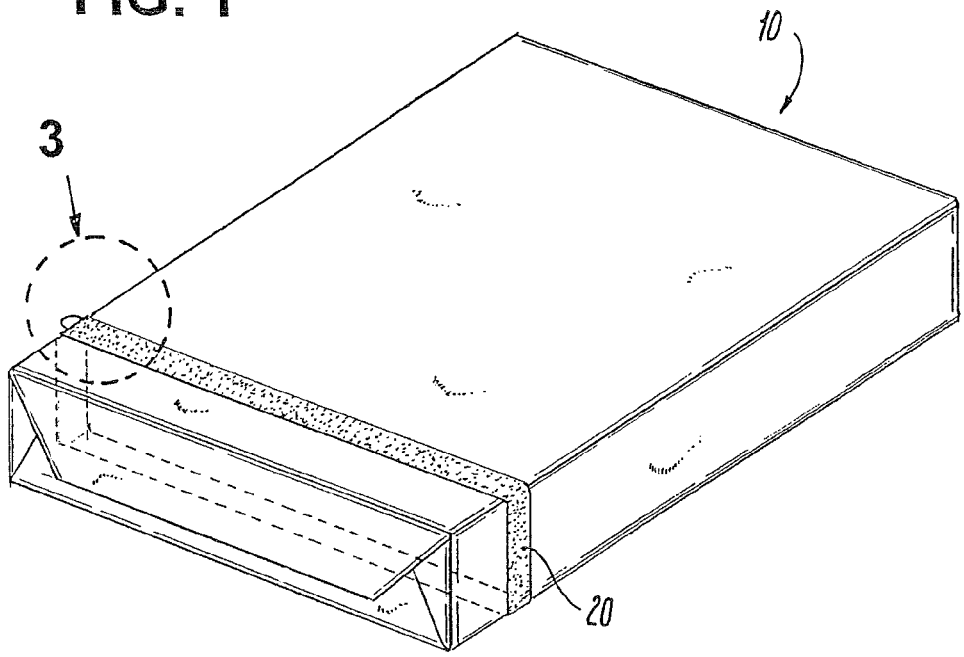
FIG. 1 is a front view showing the ream wrap having a tear tape in the closed position.
Figure 2:
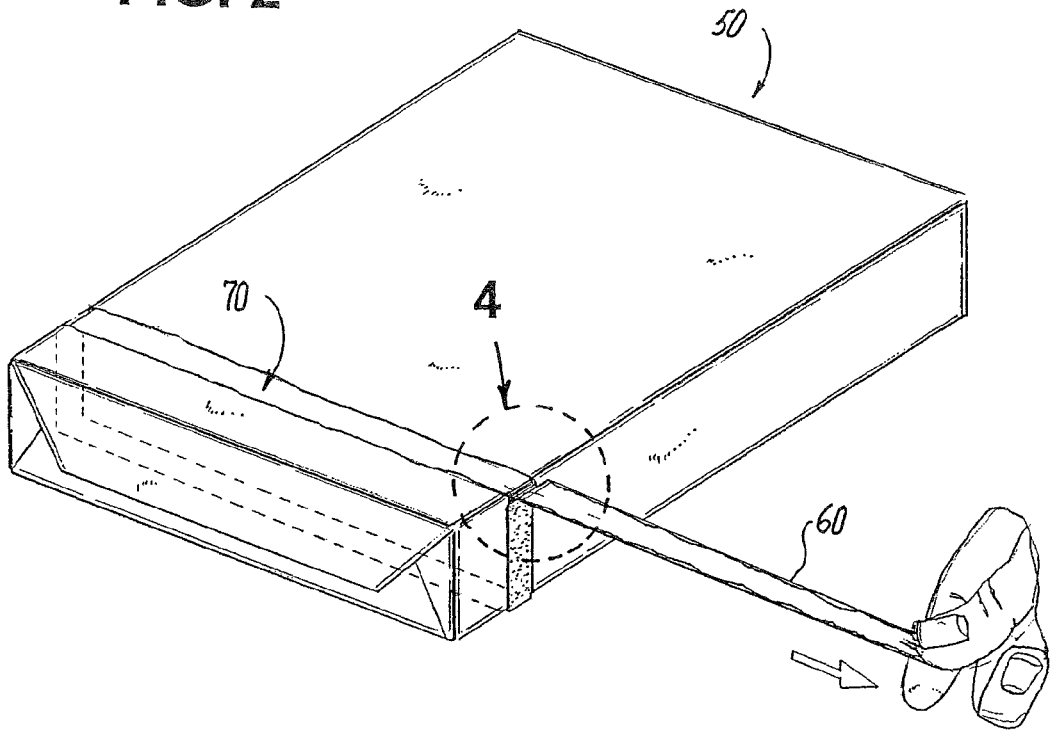
FIG. 2 is a ream wrap having the tear tape in the open position.

FIG. 1 shows a ream wrap 10 having a tear tape 20 wherein the ream wrap is closed. FIG. 2 shows ream wrap 50 having the tear tape 60, which has been pulled across the ream wrap leaving an opening 70.

Figure 3:
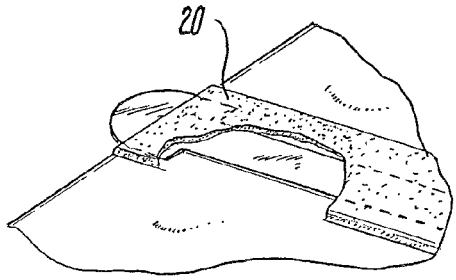
FIG. 3 is a cross sectional view of the tear tape shown in FIG. 1.
Figure 4:
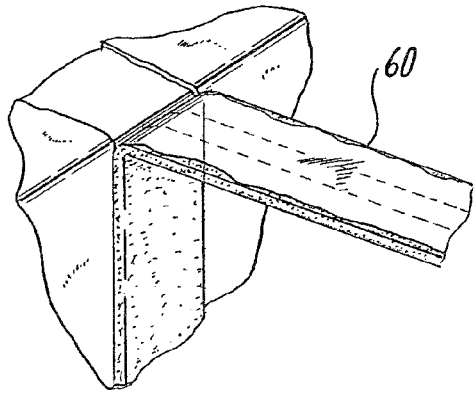
FIG. 4 is a cross sectional view of the tear tape shown in FIG. 2.
Figure 5:
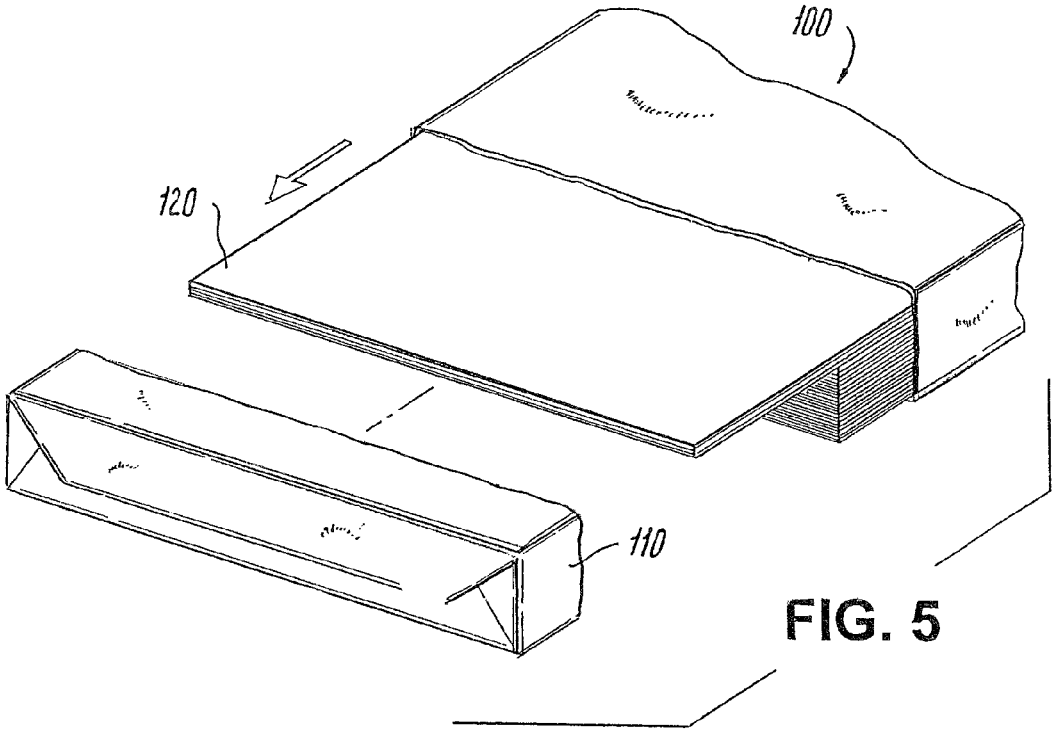
FIG. 5 shows the ream wrap after a tear tape has removed; a section of the ream wrap.

FIG. 3 shows a cross sectional view of the tear tape attached to the ream wrap shown in FIG. 1. FIG. 4 shows a cross sectional view of the tear tape shown in FIG. 2. FIG. 5 shows the ream wrap 100 after a tear tape has removed a section of the ream wrap 110 allowing the paper 120 to be retrieved and stored in the ream wrap.

FIG. 6 shows a ream wrap 200 having a tear tape 210 wherein the ream wrap is closed. FIG. 7 shows a ream wrap 250 having the tear tape 260 which has been pulled across the ream wrap leaving an opening 270.

FIG. 8 shows a cross sectional view of the tear tape attached to the ream wrap shown in FIG. 6. The tear tape 210 is attached to the ream wrap 200 by a heat seal. FIG. 9 shows a cross sectional view of the tear tape shown in FIG. 7.

FIG. 10 shows a ream wrap 300 having a tear tape 310 wherein the ream wrap is closed. FIG. 11 shows a ream wrap 360 having the tear tape 360 which has been pulled across the ream wrap leaving an opening 370.

FIG. 12 shows a cross sectional view of the tear tape attached to the ream wrap shown in FIG. 10. The tear tape 310 is attached to the ream wrap 300 by an adhesive. FIG. 13 is a cross sectional view of the tear tape shown in FIG. 11.

Figure 14:
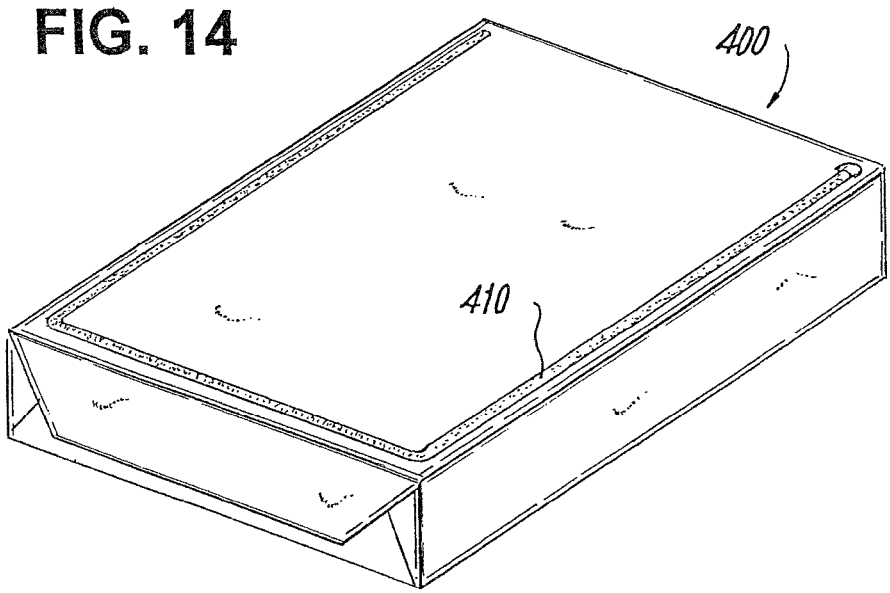
FIG. 14 is a top view showing the ream wrap in the closed position.
Figure 15:
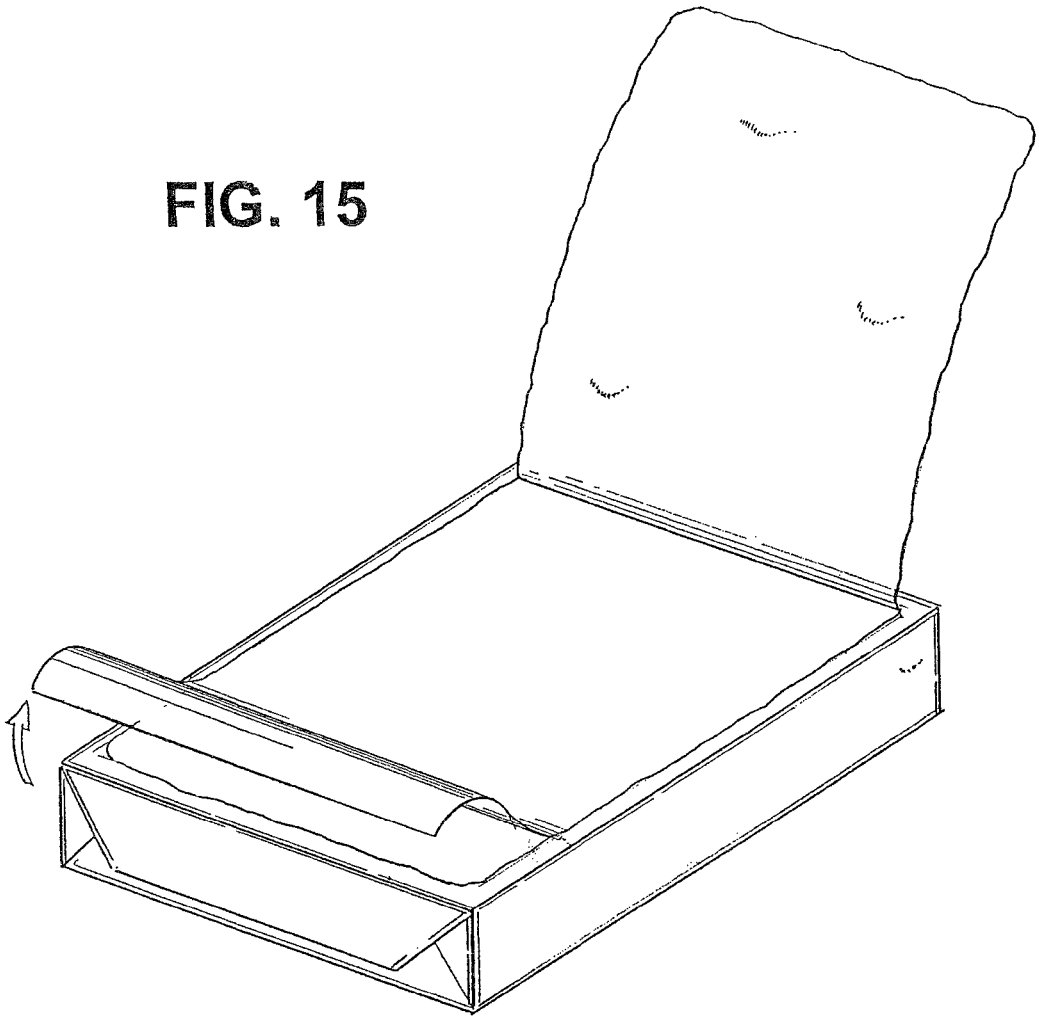
FIG. 15 is a top view showing the ream wrap in the open position.

FIG. 14 shows an alternate embodiment wherein the ream wrap 400 has a tear tape 410 on top of the ream wrap which opens the top of the ream wrap but keeps the integrity of the ream wrap. FIG. 15 shows the ream wrap of FIG. 14 in the open position.

Figure 16:
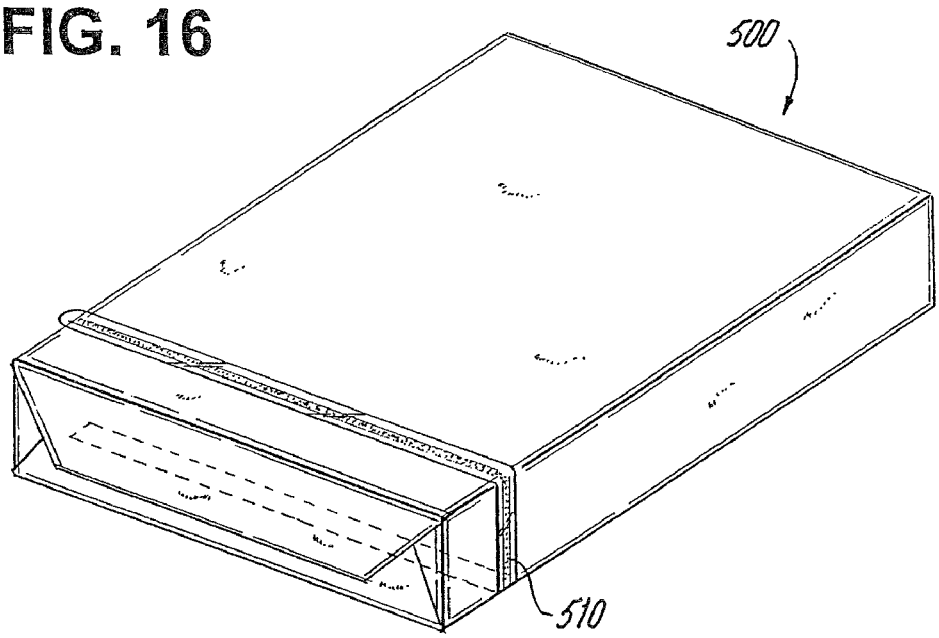
FIG. 16 is a top view of the ream wrap in the closed position.
Figure 17:
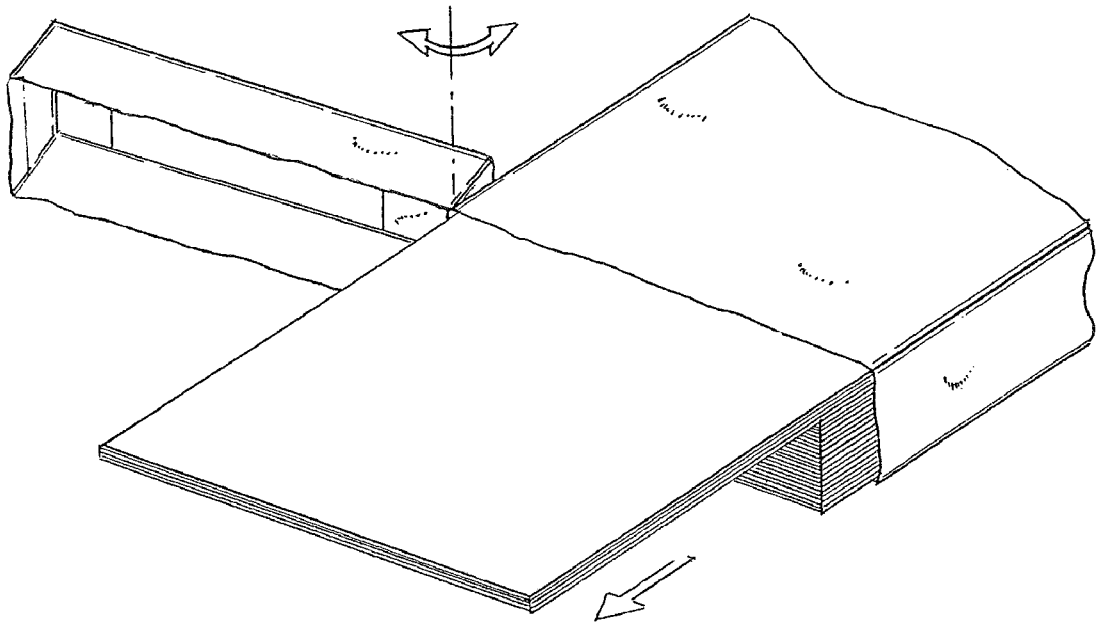
FIG. 17 is a top view of the ream wrap in the open position.

FIG. 16 shows an alternate embodiment wherein the ream wrap 500 has a tear tape 510 that does not completely remove a section of the ream wrap. FIG. 17 shows the ream wrap of FIG. 16 in the open position.

What is claimed is:

1. A method of storing and dispensing paper in a ream wrap having a tear tape, which comprises:

pulling the tear tape across the ream wrap and tearing an opening in a section of said ream wrap through which the paper is dispensed wherein said section and said ream wrap remain connected together while the paper is dispensable through said opening;

said section and said ream wrap are undivided from each other by either said tear tape or said opening; and a bottom and four sides of said ream wrap are connected together and are each unopened by either said tear tape or said opening.

2. The method as recited in claim 1, wherein said tear tape comprises a non-coated strip of paper or film that is heat-sealed onto said ream wrap.

3. The method as recited in claim 1, comprising:

pulling the tear tape located on a top of said ream wrap, and tearing the opening only in the top of said ream wrap.

4. The method as recited in claim 3, wherein said tear tape comprises a non-coated strip of paper or film that is heat-sealed onto said ream wrap.

5. The method as recited in claim 1, comprising:

removing said section of the ream wrap from the paper in said ream wrap, without removing said section of the ream wrap from said ream wrap.

* * * * *